United States Patent [19]

Antonious

[11] Patent Number: 5,046,733

[45] Date of Patent: Sep. 10, 1991

[54] IRON TYPE GOLF CLUB HEAD WITH IMPROVED PERIMETER WEIGHT CONFIGURATION

[76] Inventor: Anthony J. Antonious, 205 E. Joppa Rd., Towson, Md. 21204

[21] Appl. No.: 445,791

[22] Filed: Dec. 4, 1989

[51] Int. Cl.[5] ..... A63B 53/04

[52] U.S. Cl. ..... 273/77 A; 273/167 F; 273/169; 273/167 H

[58] Field of Search ..... 273/167-175, 273/164, 77 R, 77 A; D21/214-220

[56] References Cited

U.S. PATENT DOCUMENTS

| | | | |
|---|---|---|---|
| D. 92,266 | 5/1934 | Nicoll | 273/167 F X |
| D. 163,961 | 7/1951 | Penna | 273/167 D X |
| D. 164,596 | 9/1951 | Penna | 273/167 D X |
| D. 164,597 | 9/1951 | Penna | 273/167 D X |
| D. 269,101 | 5/1983 | Reymann et al. | D21/220 |
| D. 306,195 | 2/1990 | MacNally et al. | D21/220 |
| 1,671,956 | 5/1928 | Sime | 273/167 A |
| 3,059,926 | 10/1962 | Johnstone | 273/77 A |
| 3,749,408 | 7/1973 | Mills | 273/171 |
| 3,814,437 | 6/1974 | Winquist | 273/167 R |
| 4,420,156 | 12/1983 | Campau | 273/77 A |
| 4,632,400 | 12/1986 | Boone | 273/164 |
| 4,715,601 | 12/1987 | Lamanna | 273/77 A |

FOREIGN PATENT DOCUMENTS

| | | | |
|---|---|---|---|
| 2165461 | 4/1986 | United Kingdom | 273/169 |

OTHER PUBLICATIONS

"Golf Digest" Magazine, Aug. 1979 Issue, p. 25.

*Primary Examiner*—Edward M. Coven
*Assistant Examiner*—Sebastiano Passaniti
*Attorney, Agent, or Firm*—N. J. Aquilino

[57] ABSTRACT

An iron type golf club head having a first outer peripheral mass projecting rearwardly from the rear surface and forming a cavity thereon. The club head includes a second inner peripheral mass adjacent the outer peripheral mass and between the center of gravity of the club head and the outer peripheral mass, formed in a heel to toe direction and extending rearwardly beyond the first outer peripheral mass.

32 Claims, 9 Drawing Sheets

IRON TYPE GOLF CLUB HEAD WITH IMPROVED PERIMETER WEIGHT CONFIGURATION

BACKGROUND OF THE INVENTION

The present invention relates to perimeter weighted golf club heads, and more particularly to a cavity back iron type golf club head having a dual weight configuration adjacent the perimeter periphery of the club head.

Since the advent of perimeter weighted golf club heads, various attempts have been made at maximizing the weight configuration in order to provide a golf club head which maximizes off-enter hits while at the same time providing optimum performance when a ball is struck precisely on or adjacent the center of gravity and/or the center of percussion of the club head. Designs which concentrate the weight at the bottom of the club head and adjacent the heel and toe areas provide better shot making characteristics when a ball is hit off of the sweet spot of the golf club head. However, these club heads do not provide maximum energy transfer to a ball when directly struck on, or adjacent to, the sweet spot as with more conventional solid back club heads. To overcome these deficiencies various weight configurations have been proposed, among them applicant's own U.S. Pat. No. 4,826,172, as well as a variety of others.

Although the iron type golf club heads which have evolved from the original flat blades have produced improvements, these designs have limitations in distance, feel and control.

SUMMARY OF THE INVENTION

The present invention provides a peripheral weighted iron type golf club head having a second peripheral weight member adjacent the first peripheral weight thereby creating a dual perimeter weight configuration designed and structured to provide increased control, feel, greater accuracy and distance when striking a golf ball.

One of the objects of the invention is to provide an iron type golf club head design which maximizes energy transfer to a ball being struck while maintaining improved control, feel, accuracy and distance. Still another object is to provide a golf club head which minimizes variances in a golf ball's flight if a ball is hit off-center. Still another object is to improve conventional perimeter weighted golf club heads by providing a dual perimeter weight configuration which maximize off-center hits of a ball causing it to go further and straighter.

Other objects and advantages of the invention will become apparent from the description which follows taken in combination with the drawings.

To achieve the objects, and in accordance with the purpose of the invention, the invention comprises a weight distribution system for an iron type golf club head including a first outer peripheral mass formed on at least the heel, toe and lower portions of the rear surfaces of the club head which define a cavity within the rear surface and a secondary inner peripheral mass formed on the rear surface of the club head.

Various embodiments of the present invention are contemplated where the secondary inner peripheral weight mass is located adjacent to the bottom of the club, adjacent to top portion of the club, and substantially around and within the entire outer perimeter of the club, both at the top and bottom.

The accompanying drawings illustrate the various embodiments of the invention, and serve to explain the principles thereof.

DESCRIPTION OF THE PREFERRED EMBODIMENTS

Figure 1:
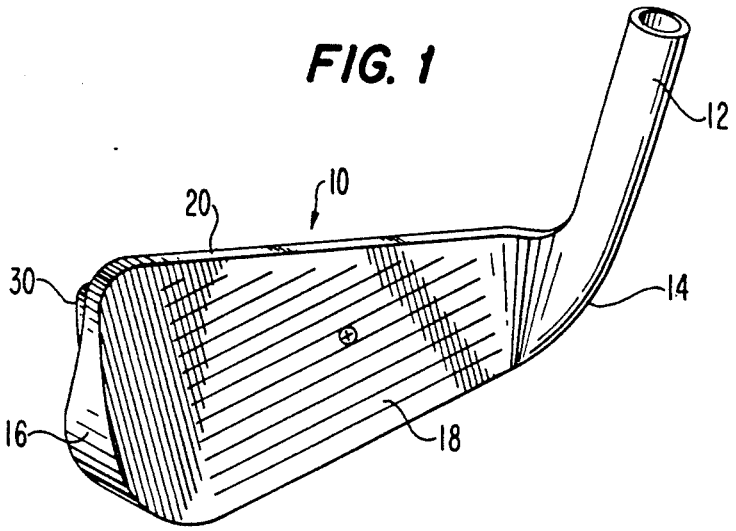
FIG. 1 is a front perspective view of an iron type golf club head in accordance with the present invention.
Figure 2:
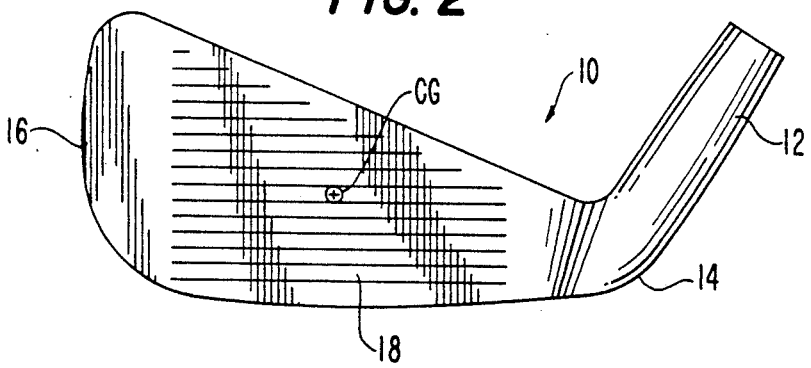
FIG. 2 is a front elevational view thereof.

Referring to the drawings, FIGS. 1 to 8 show various views of a first embodiment of an iron type golf club head 10 of the present invention. The club head 10 includes a hosel 12, heel 14, toe 16 and ball striking face 18. The club includes a top ridge 20 and sole 22. The rear of the club head 10 includes an outer peripheral mass 24 forming a cavity 26, the bottom surface of which corresponds with the innermost rear surface of the club head.

Figure 3:
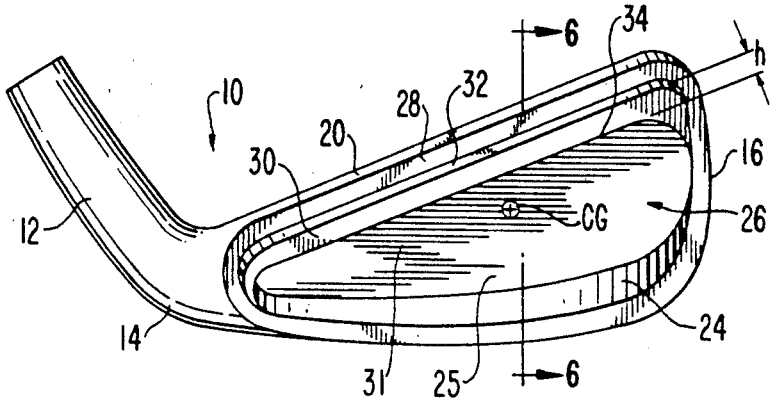
FIG. 3 is a rear elevational view thereof.
Figure 4:
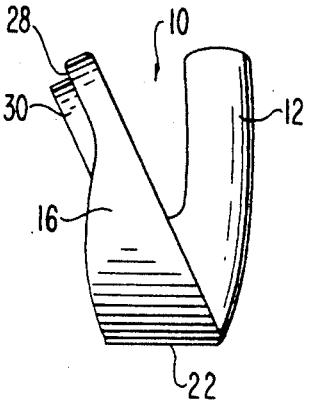
FIG. 4 is an end elevational view.
Figure 5:
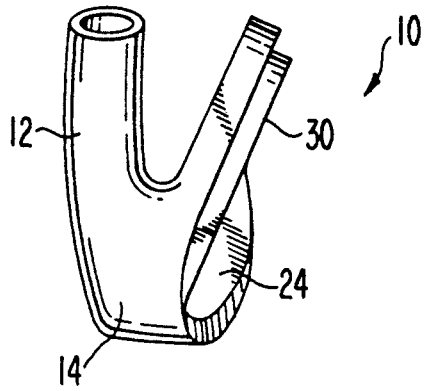
FIG. 5 is an end elevational view taken from the opposite side of FIG. 4.
Figure 6:
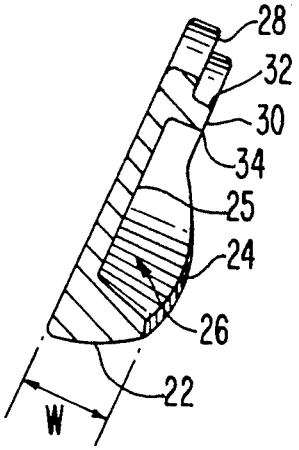
FIG. 6 is an end sectional view taken along the lines 6—6 of FIG. 3.

The outer peripheral mass 24 of the cavity back club head 10 projects outwardly away from the rear face 25, and concentrates the weight of the club head around the periphery as best illustrated in FIGS. 3 and 6. In the particular embodiment shown, outer peripheral mass 24 is concentrated adjacent the sole 22, as well as the toe 16 and heel 14 of the club head. The peripheral weight illustrates some degree of recess between the top rear surface 28 and the rear wall 25. It will be appreciated however, that the invention is equally applicable to iron type club heads in which the rear face and top rear surface of the club head are substantially flush.

A second elongated inner peripheral mass 30 formed adjacent the upper portion of the outer peripheral mass 24 extends rearwardly and is spaced below the top ridge 20 of the club head 10. The peripheral mass 30 generally follows the lines of the cavity 26 and top ridge 20 of the club head and to define the secondary, inner peripheral weight configuration. As shown in FIG. 3, the top edge 32 and the bottom edge 34 are generally parallel to each other and also parallel to the top ridge 20. The rear face of the secondary perimeter weight mass 30 has a height "H" (shown in FIG. 3) that is at least 0.150 inches and preferrably greater than 0.025 inches. This rear face 31 of the secondary perimeter mass 30 is spaced at least 0.350 inches from the front, striking face of the club. This rear face is also spaced from the rear face of the top surface 28, preferably by at least 0.125 inches. The top surface of the secondary peripheral mass projects outwardly from the top rear surface 28 at approximately a 90 degree angle. As a result, the secondary perimeter weight mass provides a substantial secondary mass between the top of the club head and the club's center of gravity (CG).

The overall length of the secondary inner peripheral weight mass conforms to the longitudinal length of the club head, and preferably extends the entire length of the rear cavity 26. The secondary peripheral mass 30 has substantially the same height "H", along its length.

The secondary peripheral mass represents a significant additional mass at the top of the club head.

The overall weight of the club head is within the weight range of conventional club heads so as to provide a total weight and swing weight, when fitted with a suitable golf club shaft, to provide a feel and swing properties consistant with the conventional golf clubs. This is accomplished by elimination of weight material from various parts of the club head including, but not necessarily limited to, the lower outer peripheral mass 24. In a preferred embodiment, the sole of the club head is reduced to a width "W" (as shown in FIG. 6), thereby reducing club head drag. The width is preferably less than 0.750 inches, more preferably less than 0.500 inches.

The structure of the embodiment illustrated in FIGS. 1–8 provides a golf club head wherein more of the mass is moved upwardly toward the top of the club head, and wherein the mass is formed closer to the center of percussion/center of gravity (CG) of the club head. This redistribution of weight provides a golfer with a club head that produces a more solid impact with the ball while increasing the control of the club particularly if the ball is hit off-center. When the ball is hit approximately at the center of the club head, substantially all of the kinetic force applied is transferred to the ball providing greater distance and accuracy which results primarily because of the closer location of the additional secondary inner peripheral mass to the center of gravity (CG). Because the secondary inner peripheral mass is located closer to where the ball is actually struck, the tendency of the club head to torque is reduced, if not eliminated, thereby increasing the force transferred to the ball. The location of the secondary inner peripheral mass also increases the stability of the club head as it impacts a ball which aids a golfer in executing and completing a more perfect golf shot.

It will be appreciated that the size of the secondary inner peripheral mass can be varied to suit the individual needs of particular golfers, or for particular performance purposes. For example, a golfer who would tend to hit a ball higher up on the face of the iron would benefit from a secondary perimeter mass of greater size than a golfer who hit the ball toward the bottom of the club face. Similarly, more of the weight of the secondary inner peripheral mass could be provided adjacent the heel or adjacent the toe of the club head to accommodate the various swing characteristics of individual players.

Figure 7:
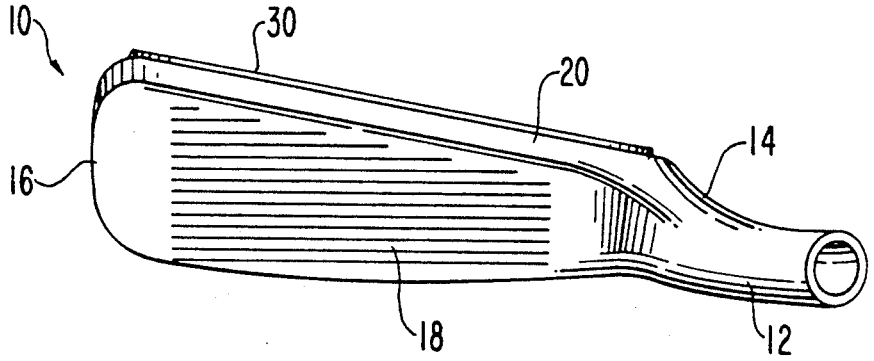
FIG. 7 is a top plan view thereof.
Figure 8:
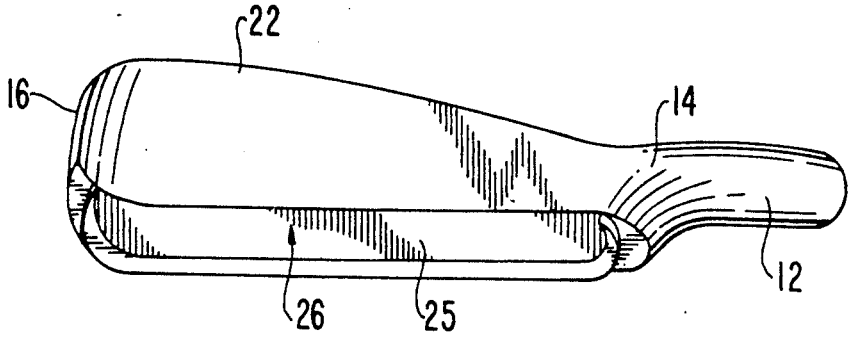
FIG. 8 is a bottom view thereof.

FIG. 7 shows that the secondary inner peripheral weight 30 can be seen when the golf club head is placed on a ground surface in a normal play position. Thus, the secondary inner peripheral weight member, in addition to actually providing additional weight, also provides the appearance of more bulk or mass closer to the center of gravity (CG) of the club head while actually not increasing the overall weight thereof to instill confidence in a player that the club head is better designed and balanced to impart significant energy to a golf ball.

Figure 9:
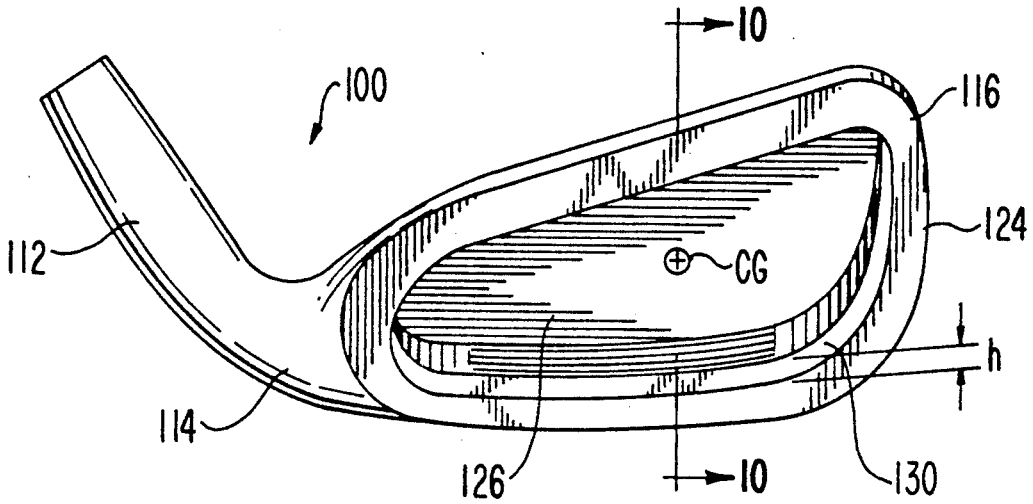
FIG. 9 is a rear elevational view of a second embodiment of an iron type golf club head of the present invention.
Figure 10:
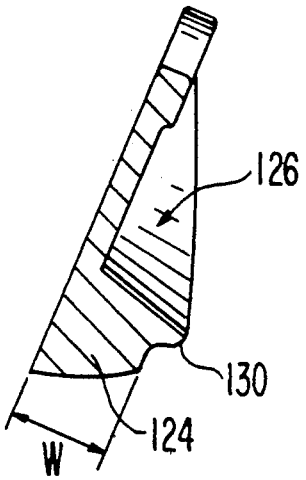
FIG. 10 is a side sectional view taken along the lines 10—10 of FIG. 9.

FIGS. 9 and 10 illustrates a second embodiment of a golf club head 100 in accordance with the present invention. The club head 100 includes a hosel 112, heel 114, toe 116, and an outer peripheral mass 124 which forms a rear cavity 126. In this embodiment, the secondary inner peipheral mass 130 is formed along the bottom portion of the outer peripheral mass 124 below the cavity 126 and extends beyond outer peripheral mass 124 from the toe 116 to the heel 114. This embodiment provides more weight at the bottom of the club head 100 and also positions the weight closer to the center of gravity (CG) of the club head 100.

The rear face of the secondary peripheral mass 130 has a height "H" (shown in FIG. 9) that is at least 0.150 inches and preferably at least 0.200 inches. This rear face is spaced rearwardly from the rear face 125 of the outer peripheral member 124 preferably by at least 0.060 inches. The bottom surface of the secondary peripheral mass 130 projects outwardly from the rear bottom surface of member 124. The secondary inner peripheral mass 130 extends along the entire length of the rear cavity 126, and has substantially the same height "H" along its length.

The second embodiment shown in FIGS. 9 and 10 is designed so that the overall weight of the club head is within the range of conventional clubs. This is accomplished by elimination of weight materials from other parts of the club, most preferably in the sole area of the club. In the preferred embodiment, the sole of the club head has a width "W" from the front face to the rear surface of the outer peripheral weight mass 124 of less than 0.750 inches and more preferably less than 0.500 inches. As a result, the club head has less functional drag, and more weight is close to the center of gravity (CG).

Figure 11:
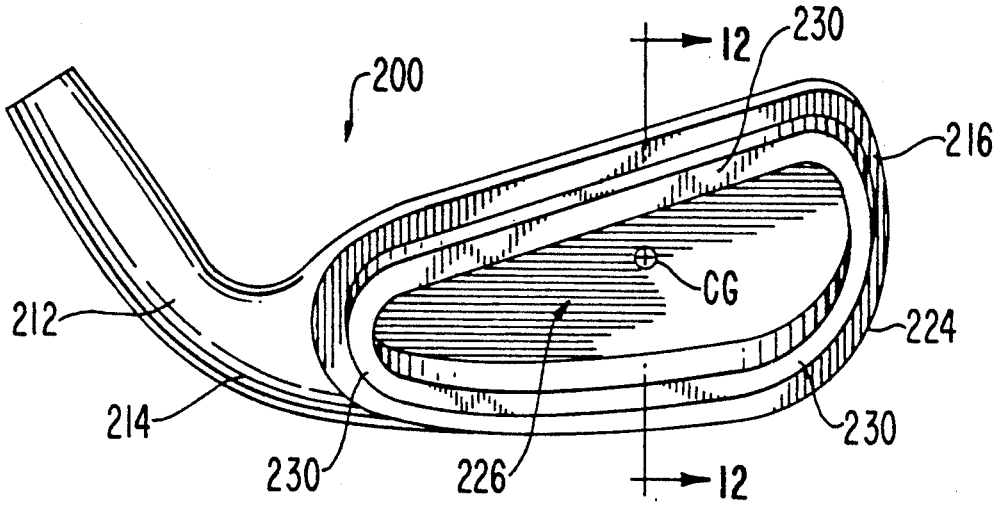
FIG. 11 is a rear elevational view of a third embodiment of the present invention.
Figure 12:
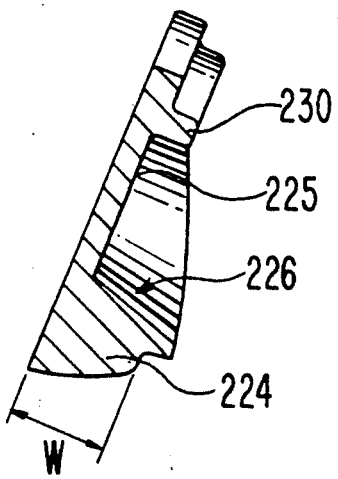
FIG. 12 is an end sectional view taken along the lines 12—12 of FIG. 11.

FIGS. 11 and 12 illustrate a third embodiment of a golf club head 200 of the present invention including a hosel 212, heel 214, toe 216 and an outer peripheral mass 224 which forms a rear cavity 226. In this embodiment the secondary inner perpheral mass 230 is formed along the entire outer perimeter of the cavity 226 and extends outwardly from and beyond the outer peripheral mass 224 and the rear surface 225. The secondary mass 230, at its top and bottom portions, has dimensions within the ranges previously described with reference to masses 30 and 130, respectively. The side portions of the mass 230 similarly have approximately the same thickness as the top and bottom portions. The club head 200 provides more weight around the periphery but closer to the center of gravity (CG) of the club head 200. Club heads made according to the third embodiment are again designed so that the overall weight of the club heads are within conventional ranges. This is achieved principly by taking weight from the sole of the club head, particularly its thickness or width between the face and the rear surface of the club head at the sole. Club heads made according to the third embodment preferably have soles which have a width "W" which is less than 0.750 inches, most preferably less than 0.500 inches. The decrease in sole thickness substantially reduces club head drag.

Figure 13:
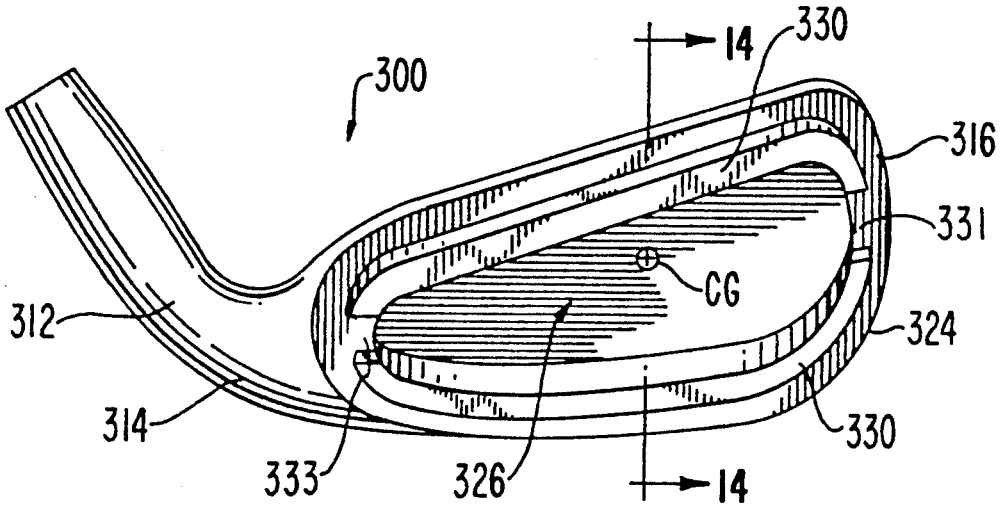
FIG. 13 is a rear elevational view of a fourth embodiment of the present invention.
Figure 14:
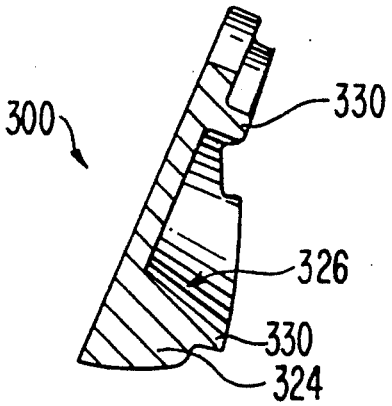
FIG. 14 is an end sectional view taken along the lines 14—14 of FIG. 13.

FIGS. 13 and 14 illustrate a fourth embodiment of a golf club head 300 of the present invention including a hosel 312, heel 314, toe 316 and an outer peripheral mass 324 which forms a rear cavity 326. In this embodiment the secondary inner peripheral mass 330 extends substantially around, beyond and within the entire outer perimeter of the cavity 326 with the exception of a gap 331 formed between the upper and lower weight members 330, at the toe 316 and a gap 333 formed between the upper and lower portions of the weight member 330, at the heel 314. Here again, as with the previous embodiment, more weight is provided closer to the center of gravity (CG) of the club head 300. The top, bottom, and side portions of the mass 330 have dimensions substantially the same as those described with reference to the third embodiment and the overall weight characteristics of the club head are similar to conventional club heads in the same manner as described hereinabove.

Figure 15:
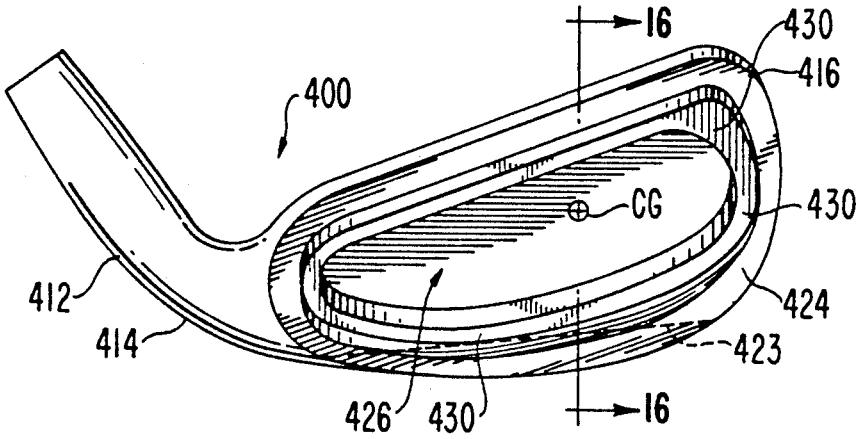
FIG. 15 is a rear elevational view of a fifth embodiment of the present invention.
Figure 16:
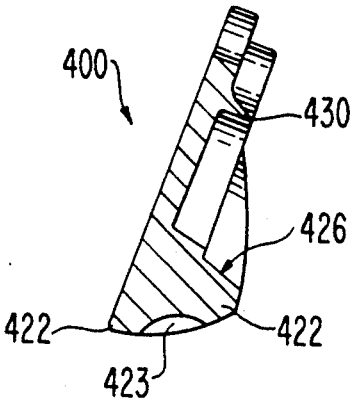
FIG. 16 is a side sectional view taken along the lines 16—16 of FIG. 15.

FIGS. 15 and 16 show a fifth embodiment of a golf club head 400 of the present invention including a hosel 412, heel 414, toe 416 and an outer peripheral mass 424 which forms a rear cavity 426. In this embodiment, the secondary inner peripheral weight 430 extends around and within the entire outer perimeter of the cavity 426. The upper portion of the secondary inner peripheral 430 extends beyond the outer peripheral mass 424 in the rearward direction whereas the lower portion of the secondary inner peripheral mass 430 is formed within the cavity 426 and therefore it does not extend beyond the outer peripheral mass 424 at that point. As with the previous embodiments, more weight is provided closer to the center of gravity (CG) of the club head 400.

Figure 16A:
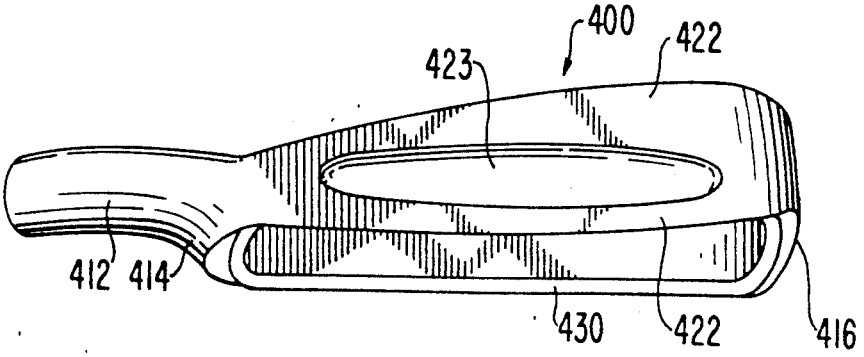
FIG. 16A shows a bottom view of the club head of FIG. 15.

Alternately, the overall weight of the club head may be regulated by forming a slot or groove 423 in the sole 422 of the club head 400 as shown in FIGS. 16 and 16A.

The top and side portions of the mass 430 of the fifth embodiment are substantially the same as those described with respect to the other embodiments hereinabove. As shown in FIG. 16, the rear face at the bottom portion of the inner mass 430 and the rear face at the top portion of the inner mass 430 are spaced from the front face of the club by approximately the same distance. The two rear faces, thus, are aligned with each other, as are the rear faces of the side portions. In this embodiment, as compared to the third embodiment shown in FIGS. 11 and 12, it is possible to keep the overall club head weight within conventional ranges by regulating the width of the sole.

Figure 17:
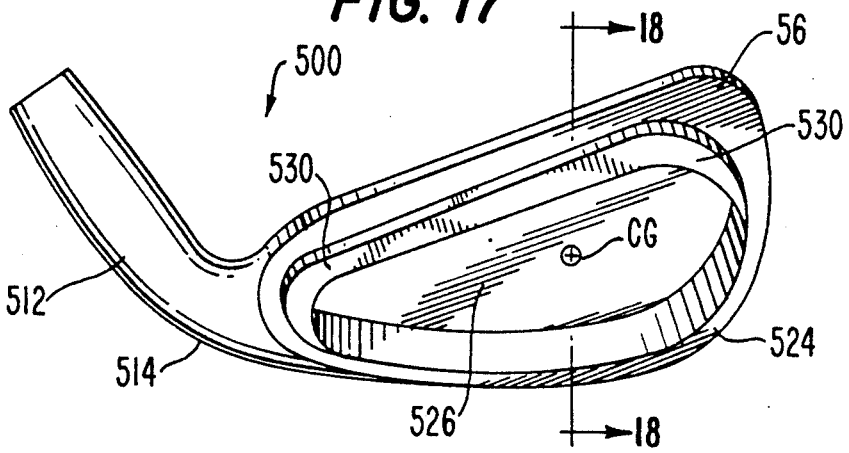
FIG. 17 is a rear elevational view of a sixth embodiment of the present invention.
Figure 18:
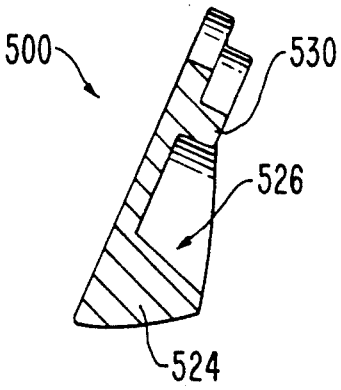
FIG. 18 is an end sectional view taken along the lines 18—18 of FIG. 17.

FIGS. 17 and 18 show a sixth embodiment of the club head 500 of the present invention including a hosel 512, heel 514, toe 516 and an outer peripheral mass 524 which forms a rear cavity 526. In this embodiment the secondary inner peripheral mass 530, like the first embodiment shown in FIGS. 1 to 8 is an elongated rearwardly extending mass formed above the cavity 526 and extends between the heel 514 and toe 516. In this embodiment the secondary inner peripheral weight 530 is thicker and extends only part way to the end of the toe 516 as compared to the first embodiment structure. This embodiment concentrates more mass adjacent the club head center of gravity (CG).

FIGS. 19, 20, 21 and 22 all show embodiments of golf club heads using tertiary weight masses at various locations to distribute the overall weight of the club head in the heel to toe direction depending upon the iron being used.

Figure 19:
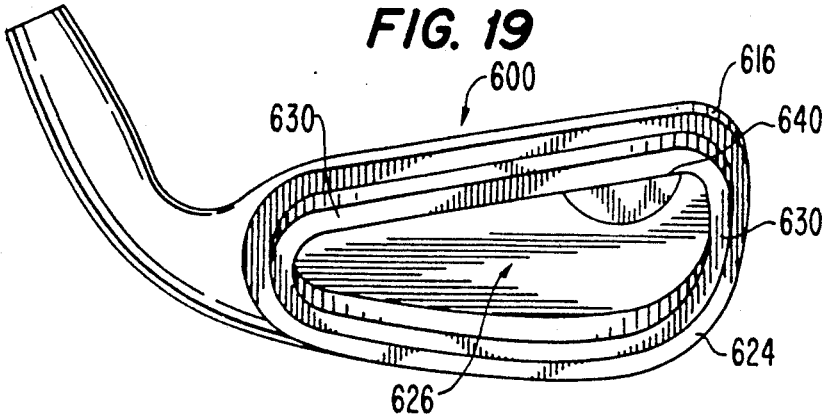
FIG. 19 is a rear elevational view of an seventh embodiment of the present invention.

FIG. 19 shows a club head 600 which is generally similar to the embodiment shown in FIG. 11, and includes an outer peripheral mass 624 forming a cavity 626 and a secondary inner peripheral weight 630. A tertiary weight mass 640 is located adjacent the upper toe 616 to distribute more weight in this area, perferably for irons of relatively low degree loft such as the Number one or the Number two irons.

Figure 20:
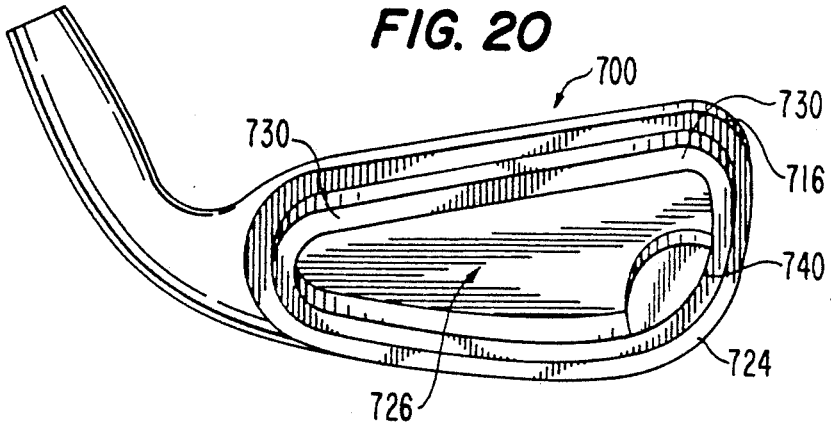
FIG. 20 is a rear elevational view of a eighth embodiment of the present invention.

FIG. 20 shows a club head 700 which is similar to the embodiment shown in FIG. 11, and includes an outer peripheral mass 724 forming a cavity 726 and a secondary inner peripheral weight 730. A tertiary weight mass 740 is located adjacent the lower toe 716 to distribute more weight in this area preferably for low degree loft irons such as the Number 3, 4, and 5 irons.

Figure 21:
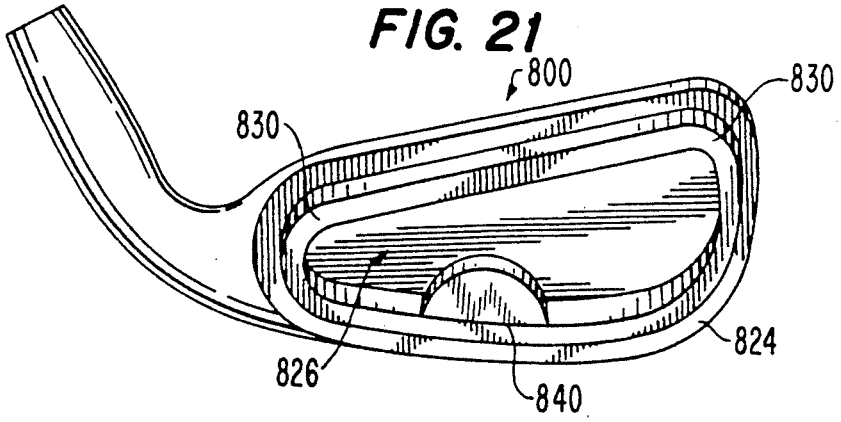
FIG. 21 is a rear elevational view of a ninth embodiment of the present invention.

FIG. 21 shows a club head 800 again generally similar to the embodiment shown in FIG. 11 which includes an outer peripheral mass 824 forming a cavity 826 and having a secondary inner peripheral weight 830. A tertiary weight mass 840 is centrally located approximately mid-way at the bottom of the cavity 826 to distribute more weight in this area preferably for irons of relatively higher degree loft such as the Number 6, 7, and 8 irons.

Figure 22:
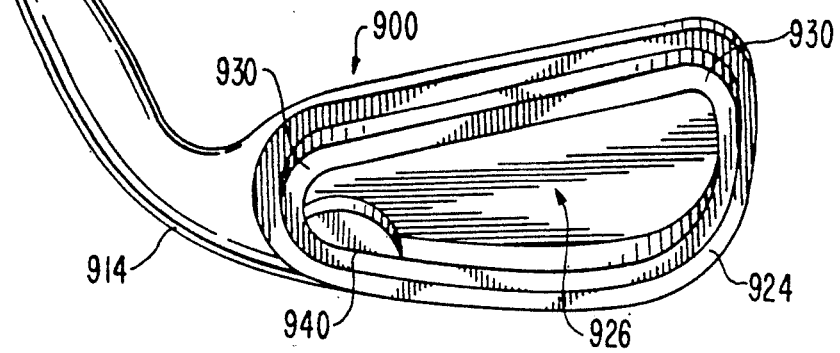
FIG. 22 is a rear elevational view of an tenth embodiment of the present invention.

FIG. 22 shows a golf club head 900 similar to the embodiment shown in FIG. 11 which includes an outer peripheral mass 924 forming a cavity 926 and a secondary inner peripheral weight 930. A tertiary weight mass 940 is located adjacent the heel 914 to distribute more weight in this area, preferably for irons of high degree loft such as Number 9 irons and wedges.

Figure 23:
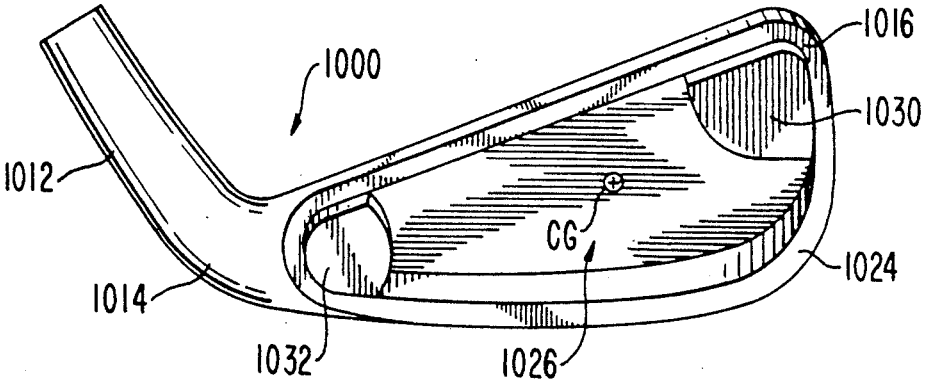
FIG. 23 is a rear elevational view of a eleventh embodiment of the present invention.

FIG. 23 shows an eleventh embodiment of a club head 1000 of the present invention including a hosel 1012, heel 1014, toe 1016 and outer peripheral mass 1024 which forms a rear cavity 1026. In this embodiment, a pair of independent inner peripheral weight members 1030 and 1032 are formed adjacent to and extend individually beyond the outer peripheral mass 1024 of the club head. The added weight at the upper toe and lower heel provided by the weight members 1030 and 1032, respectively, increases the stability and efficiency of the club head.

Figure 24:
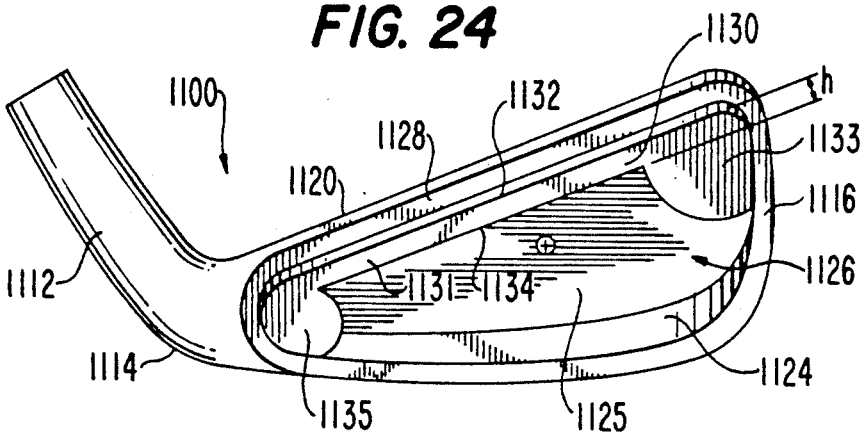
FIG. 24 is a rear elevational view of a twelfth embodiment of the present invention.

FIG. 24 illustrates a twelfth embodiment of the club head 1100 of the present invention including a hosel 1112, heel 1114, toe 1116 and outer peripheral mass 1124 which forms a rear cavity 1126. A secondary peripheral mass 1130 is spaced from the top ridge 1120 and runs parallel in a heel to toe direction of the top portion 1128 of the club head. The mass 1130 includes lateral extensions 1133 and 1135 which extend slightly into the toe and heel areas, respectively of the club head 1100. The lateral extensions place added mass at the upper toe area and the lower heel area of the club head. Preferrably, the lateral extensions 1133 and 1135 are thicker than the mass 1130, thereby concentrating additional mass at the top toe and bottom heel areas.

Figure 25:
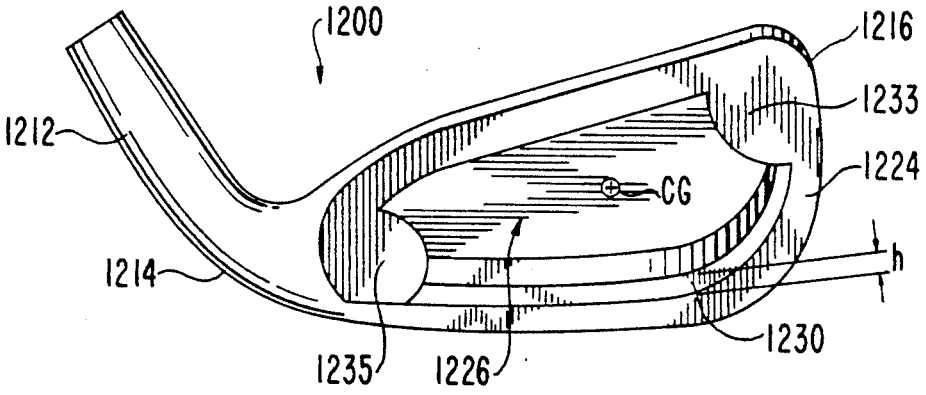
FIG. 25 is a rear elevational view of a thirteenth embodiment of the present invention.

FIG. 25 illustrates a thirteenth embodiment of a golf club head 1200 of the present invention including a hosel 1212, heel 1214, toe 1216 and outer peripheral mass 1224 which forms a rear cavity 1226. In this embodiment, a secondary inner peripheral mass 1230 is formed below the cavity 1226 and extends beyond the outer peripheral mass 1224 from the heel 1214 to toe 1216 direction. The secondary mass 1230 includes lateral extensions 1233 and 1235 which extends slightly into the toe and heel areas, respectively of the club head. The lateral extensions place added mass at the upper toe area and lower heel area of the club head 1200. Like the previous embodiment, the mass 1230 is preferrably thicker at the lateral extension, thereby concentrating the additional mass at the upper toe and lower heel areas.

Figure 26:
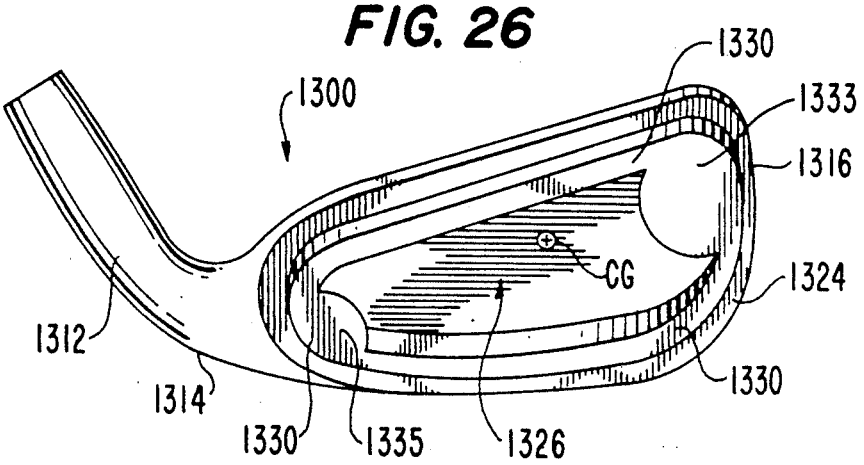
FIG. 26 is a rear elevational view of a fourteenth embodiment of the present invention.

FIG. 26 illustrates a fourteenth embodiment of a golf club head 1300 of the present invention including a hosel 1312, heel 1314, toe 1316 and outer peripheral mass 1324 which forms a rear cavity 1326. In this embodiment, the secondary inner peripheral mass 1330 is formed along the entire outer perimeter of the cavity 1326, and extends outwardly from and beyond the outer peripheral mass 1324. In the preferred form of this embodiment, extensions 1333 and 1335 are included in the side portions of the mass 1330 at the upper toe and lower heel areas which serve the same functions as the lateral extensions described with respect to the embodiments shown in FIGS. 24 and 25.

It will be appreciated that the tertiary mass members may be used at desired locations and on all the other various embodiments described hereinabove.

I claim:

1. An iron type golf club head including a hossel, a heal, a toe, a ball striking face to hit a ball along an intended line of flight, a rear wall opposite said ball striking face, an upper surface including a top ridge, a lower surface including a sole, a longitudinal axis bisecting said ball striking face between said top ridge and said sole, a center of gravity centrally located with respect to said ball striking face and an outer peripheral mass located on said club heat at an outer peripheral edge thereof and having a top rear surface projecting rearwardly from said rear wall of said club head; said outer peripheral mass and said rear wall defining a centrally located cavity formed within said outer perhipheral mass wherein the improvement comprises: a secondary, inner peripheral mass formed to lie on said outer peripheral mass and inwardly spaced from and parallel to at least a portion of said outer peripheral edge; said secondary inner peripheral mass being adjacent said cavity and extending rearwardly beyond a plane defined by said top rear surface of said outer peripheral mass and in a direction between said heel and said toe; said secondary inner peripheral mass being further defined as being located between said center of gravity and said outer peripheral edge.

2. The golf club head of claim 1 wherein said secondary inner peripheral mass extends along substantially the entire length of said cavity and is located between the upper surface of said club head and said cavity to provide a predominance of weight to the upper portion of the club head above said longitudinal axis.

3. The golf club head of claim 2 wherein said secondary inner peripheral mass includes a first lateral extension which extends downwardly into the upper toe area of the club head.

4. The golf club head of claim 3 wherein said secondary inner peripheral mass includes a second lateral extension which extends downwardly into the lower heel area of the club head.

5. The golf club head of claim 4 further including a tertiary mass located within said cavity.

6. The golf club head of claim 2 wherein a rear face of the secondary inner peripheral mass is spaced at least 0.350 inches from the front face of the club head along substantially the entire length of said secondary inner peripheral mass.

7. The golf club head of claim 6 wherein the rear face of said secondary inner peripheral mass has a height of at least 0.150 inches along substantially its entire length.

8. The golf club head of claim 6 wherein the rear face of said secondary inner peripheral mass has a height of at least 0.250 inches along substantially its entire length.

9. The golf club head of claim 2 wherein said secondary inner peripheral mass terminated adjacent said toe.

10. The golf club head of claim 2 wherein said secondary inner peripheral mass terminates adjacent said heel.

11. The golf club head of claim 1 wherein said secondary inner peripheral mass extends along substantially the entire length of said cavity and is located between the lower surface of said club head and said cavity to provide a predominance of weight to the lower portion of the club head below said longitudinal axis.

12. The golf club head of claim 11 wherein said secondary inner peripheral mass includes a first lateral extension which extends upwardly into the upper toe area of the club head.

13. The golf club head of claim 12 wherein said secondary inner peripheral mass includes a second lateral extension which extends upwardly into the lower heel area of the club head.

14. The golf club head of claim 11 wherein the rear face of said secondary inner peripheral mass has a height of at least 0.150 inches along substantially its entire length.

15. The golf club head of claim 11 wherein the rear face of said secondary inner peripheral mass has a height of at least 0.250 inches along substantially its entire length.

16. The golf club head of claim 1 wherein said secondary inner peripheral mass surrounds said cavity.

17. The golf club head of claim 16 wherein said secondary inner peripheral mass is formed as a continuous member around said cavity.

18. The golf club of claim 17 wherein an upper elongated portion of the secondary inner peripheral mass extends rearwardly beyond the outer peripheral mass and the lower elongated portion of the secondary inner peripheral mass is recessed within the outer peripheral mass.

19. The golf club head of claim 18 wherein the rear face of said secondary inner peripheral mass along its entire contour is spaced substantially the same distance from the face of the club head.

20. The golf club head of claim 16 wherein said secondary inner peripheral mass is a discontinuous member around said cavity.

21. The golf club head of claim 20 wherein said discontinuous secondary inner peripheral mass member includes gaps located at said heel and said toe on said longitudinal axis.

22. The golf club head of claim 16 wherein said secondary inner peripheral mass includes a first extension which projects inwardly toward the recess at the upper toe area of the club head.

23. The golf club head of claim 22 wherein said secondary inner peripheral mass includes a second extension which projects inwardly toward the recess at the lower heel area of the club head.

24. The golf club head of claim 13 wherein the sole of the club head has a width of less than 0.500 inches.

25. A set of golf clubs in which each club is the club head of claim 16 and the sole of each club head in the set has a width of less than 0.500 inches.

26. The golf club head of claim 1 further comprising a tertiary mass positioned between the secondary inner peripheral mass and the club head's center of gravity.

27. The golf club head of claim 26 wherein the tertiary mass is located adjacent the upper toe of the club head.

28. The golf club head of claim 26 wherein the tertiary mass is located adjacent the lower toe of the club head.

29. The golf club head of claim 26 wherein the tertiary mass is located at approximately mid-way at the bottom of the recessed cavity of the club head.

30. The golf club head of claim 26 wherein the tertiary mass is located adjacent the heel of the club head.

31. A set of golf clubs in which each club is the club head of claim 26 and wherein said tertiary mass is progressively displaced from the upper areas of the cavity to the lower areas of the cavity, as the loft of the club head increases.

32. The club head of claim 1 wherein said secondary inner peripheral mass is defined as a pair of independent inner peripheral weight members formed adjacent to and extending beyond in a rearward direction towards said outer peripheral mass.

* * * * *